United States Patent [19]

Leong et al.

[11] Patent Number: 4,504,104

[45] Date of Patent: Mar. 12, 1985

[54] UNITARY WIRING DEVICE BODY

[75] Inventors: Henry Leong, Kendall Park; John Fiumefreddo, Colonia, both of N.J.

[73] Assignee: Challenger Circle F, Inc., Trenton, N.J.

[21] Appl. No.: 541,803

[22] Filed: Oct. 18, 1983

[51] Int. Cl.[3] ..... H01R 13/502; H01R 13/58

[52] U.S. Cl. ..... 339/63 R; 339/99 R; 339/103 R

[58] Field of Search ..... 339/59 R, 59 M, 63 R, 339/63 M, 107, 196 R, 196 A, 196 M, 206 R, 206 P, 208, 103 R, 103 M, 97 P, 99 R

[56] References Cited

U.S. PATENT DOCUMENTS

| | | | |
|---|---|---|---|
| 2,590,886 | 4/1952 | Pedersen | 339/107 |
| 2,673,968 | 3/1954 | Smith | 339/99 |
| 3,409,858 | 11/1968 | Krehbiel | 339/91 |
| 3,784,961 | 1/1974 | Gartland, Jr. | 339/107 |
| 3,816,819 | 6/1974 | Judd | 339/99 |
| 4,010,999 | 3/1977 | Hoffman | 339/107 |
| 4,072,391 | 2/1978 | Hung | 339/196 R |
| 4,138,185 | 2/1979 | Jaconette, Jr. | 339/107 |
| 4,145,103 | 3/1979 | Knowles | 339/99 R |
| 4,155,617 | 5/1979 | Hung | 339/196 R |

*Primary Examiner*—Neil Abrams

*Attorney, Agent, or Firm*—Sperry, Zoda & Kane

[57] ABSTRACT

A wiring device has a unitary body including two segments connected by a plastic web. Mechanical hinges engage when the segments are close together. A latch piece is connected thereto.

5 Claims, 4 Drawing Figures

UNITARY WIRING DEVICE BODY

This application is related to our co-pending application Ser. No. 544,801 filed Oct. 18, 1983; and to application Ser. No. 541,802 filed Oct. 18, 1983 by John Fiumefreddo.

BACKGROUND OF THE INVENTION

This invention pertains to wiring devices and, more particularly, is concerned with wiring devices such as plugs and receptacles for terminating electrical cords.

Numerous designs for plugs and receptacles for terminating cords have been disclosed over the years. The so-called stripless type are now in favor for use by the domestic consumer as no tools are required other than a pair of scissors to trim the cord.

For years the common cord for lamps and the like was made to meet Underwriter's Laboratories Standard SPT-1. There is now a change over to U.L. Standard SPT-2 cord which has substantially thicker insulation. It is likely that both size cords will coexist in the home for some time. For this reason it is desirable to provide a quick connect wire device which will accept both size cords and which, at the same time, provides safety features to protect the user.

For a better understanding of the present invention, together with advantages and capabilities thereof, reference is made to the following disclosure and appended claims in connection with the above-described drawings.

DESCRIPTION OF THE INVENTION

Figure 1:
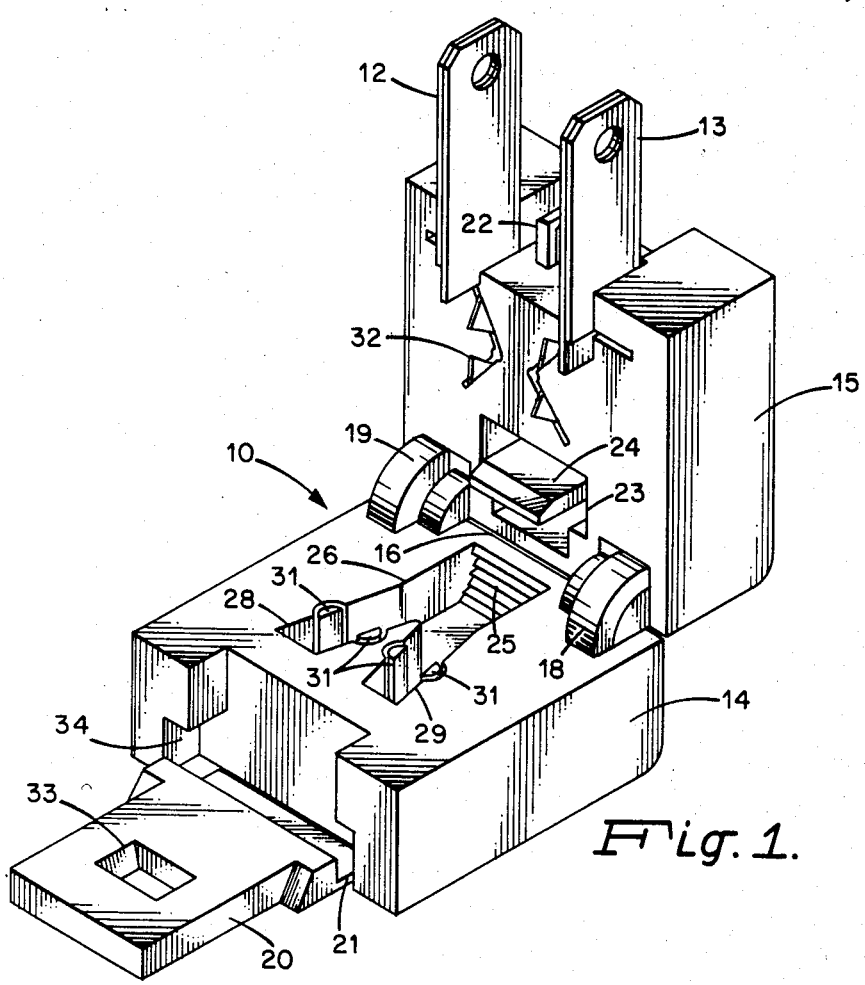
FIG. 1 shows in an open position a wiring device embodying the invention.

FIG. 1 shows a wiring device 10 which embodies the invention. The device shown is a male plug for terminating one end of a cord set; however, with minor design changes the device could be manufactured as a female receptacle.

The device has only three pieces which are a body 11 and two electrical contacts 12, 13. The contacts 12, 13 may be blades if the device is a plug and female contacts if the device is a receptacle.

Body 11 is molded in one piece of a flexible plastic such as polypropylene. The body has a first segment 14 and a second segment 15 joined by a web 16 of thin plastic, known as a living hinge. In FIG. 1 the device 10 is shown in an open position prior to receiving an electric cord.

Figure 2:
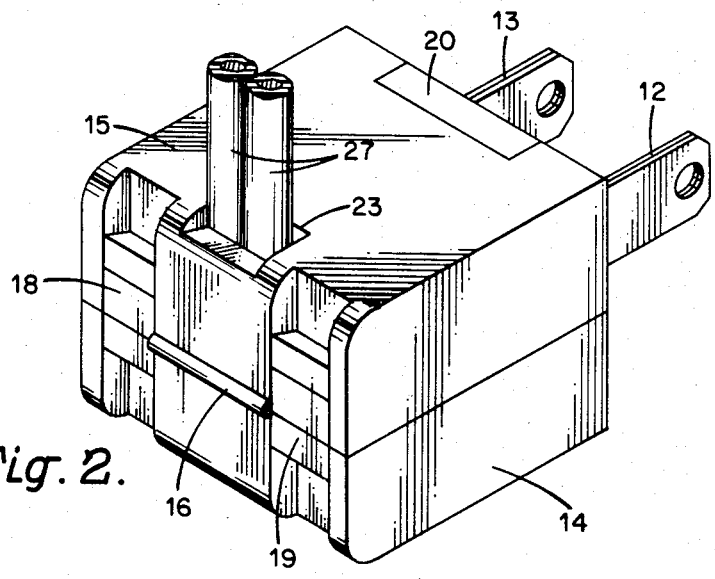
FIG. 2 shows the device of FIG. 1 in a closed position.

As seen in FIG. 2, a first living hinge 16 allows the two segments to pivot together as a book would close. Mating members of mechanical hinge 18, 19 are provided on each end of the first living hinge 16 so that if the first living hinge fails the two segments 14, 15 will remain latched together when in closed position.

The segments 14, 15 may be latched in a closed position by a latch piece 20 which is attached to a second living hinge 21 on the first segment 14. Prongs 22 on second segment 15 engage a hole 33 in latch piece 20 when the device is closed. The end of latch piece 20 nearest hinge 21 is wider than the end nearest hole 33. The first segment 14 has a corresponding recess 34 to accept the latch piece 20. When the segments are closed the latch piece 20 forms an interlocking joint with the first segment 14 so that even if the second living hinge 21 fails the segments will remain latched in a closed position. Both latch piece 20 and recess 34 may be T-shaped.

Figure 3:
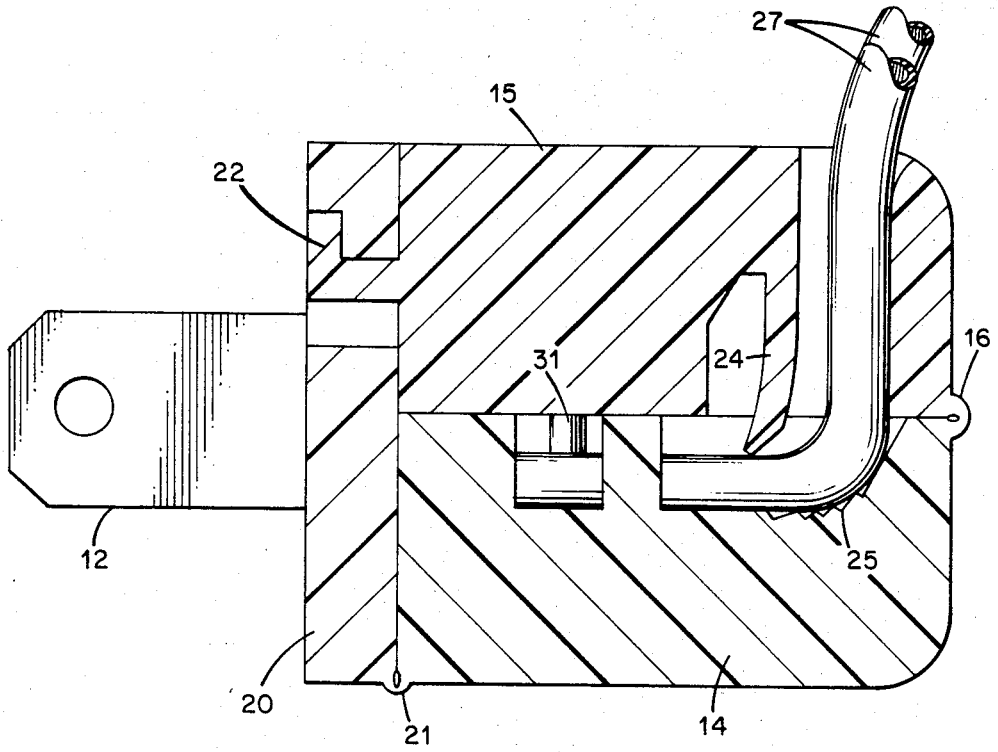
FIG. 3 illustrates in more detail the strain relief feature of the wiring device.

Prongs 22 (see FIG. 3) are L-shaped, having distal ends received in a recessed extension of the hole in latch piece 20. In these circumstances, the prongs are flush with the latch piece, and the latch piece, in its latching position, is flush with the surfaces of the latchingly engaged ends of the segments (FIGS. 2 and 3).

Returning to FIG. 1, the second segment 15 has a rectangular entry hole 23 for accepting the end of an electric cord and a flexible finger 24 located adjacent to the entry hole 23.

The first segment 14 is recessed to accept the cord. In the embodiment shown first segment 14 has a serrated corner 25 which leads the cord into a Y-shaped channel 26. As seen in FIG. 3, when the segments 14, 15 are closed the serrated corner is opposite the entry hole 23. When a cord 27 is inserted through the entry hole 23 and the segments 14, 15 are closed, the cord 27 bends around the corner into the channel 26. The tip of the flexible finger 24 is in contact with the cord 27, and if the cord is pulled, the flexible finger 24 urges the cord 27 against the serrated corner 25 locking the cord in place and providing strain relief.

Turning again to FIG. 1, channel 26 branches in two narrower channels 28, 29 which are separated by a divider 30. The cord is to be split into two wires which are laid in the separate channels 28, 29. This arrangement prevents short circuits which might otherwise occur if there are frayed wire strands.

Figure 4:
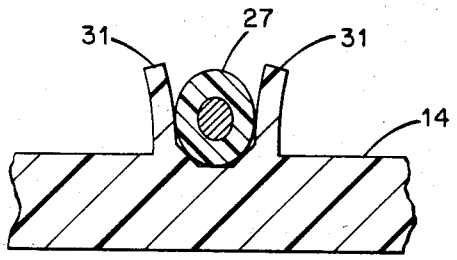
FIG. 4 shows in more detail the channel and post arrangement of the wiring device.

As best shown in FIG. 4, the bottom of the channels are beveled so that the wires self-center within their corresponding channel.

At least one pair of flexible posts 31 are provided for each narrow channel. The posts 31 of each pair are arranged on opposite sides of the narrow channel to grip the wire and hold it in the corresponding narrow channel during assembly.

Due to the adaptable strain relief and the self-centering channels with flexible posts, the device will accept different size braidless parallel cord such as that which meets U.L. specification SPT-1 and SPT-2. Both types call for 18 gauge wire. SPT-1 uses 30 mil thick insulation and separates the wires by 3/64 inch, whereas SPT-2 uses 45 mil thick insulation and separates the wires by 5/64 inch.

Electrical contacts 12, 13 are made of copper or other metal and are carried by the second segment 15. The contacts have points 32 arranged to pierce the insulation of the wire when the segments are closed. Each contact may have two or more points which are slightly offset so as to straddle the center of the wire preventing the wire from turning. The contacts may be blades or they may be female contacts with corresponding changes to the body.

The described wiring device accepts both SPT-1 and SPT-2 standard wire. Only three pieces are used in its construction and is unitary so far as the consumer is concerned.

While there has been shown and described what is at present considered the preferred embodiment of the invention, it will be obvious to those skilled in the art that various changes and modifications may be made therein without departing from the scope of the invention as defined by the appended claims.

We claim:

1. An electrical connector comprising:

(a) a one-piece body molded of electrically insulative material and including (1) a first segment having intermediate its ends a recess shaped to accept an electric cord, (2) a first flexible web integral with one end of the first segment;

(3) a second segment integral at one end with said web, said web hingedly connecting the segments at said one end thereof for relative swinging movement of the segments between an open position exposing said recess and a closed position in which the segments are in face-to-face contact to close the recess, said second segment having an entry hole for the cord which communicates with the recess in the closed position of the segments, (4) a second flexible web integral with the other end of the first segment, and (5) a latch piece integral at one end with the second web and hingedly connected thereby to said other end of the first segment for swinging movement between a disengaged position in which the latch piece frees the segments for swinging movement to their open position, and a latching position in which, with the segments closed, portions of the latch piece overlie the other ends of both segments, the other end of the second segment and the portion of the latch piece that overlies the same having mating means latchingly interengaging the latch piece with the second segment when the segments and the latch piece are in closed and latching positions respectively; and (b) a pair of contacts mounted in the second segment, having a means that projects into the recess responsive to the closing and latching of the segments to electrically connect the contacts to the cord.

2. An electrical connector as in claim 1 wherein said one end of the latch piece is greater in width than the other end thereof imparting a T-shape to the latch piece, said other end of the first segment being formed with a correspondingly T-shaped recess having a widened area corresponding to said wider one end of the latch piece and receiving the same in the latching position of the latch piece, to form an interlocking joint between the latch piece and the first segment to maintain the latching engagement of the latch piece with the respective segments, in the event of failure of the hinge connection between the latch piece and the first segment.

3. An electrical connector as in claim 2 wherein the latch piece, when in its latching position, is in flush relation to said other ends of the segments.

4. An electrical connector as in claim 3 wherein said mating means comprises prongs integrally formed on the second segment and a hole in the latching piece in which the prongs engage when the latch piece is in its latching position, said prongs being in flush relation with the latch piece and with said other ends of the respective segments when the latch piece is in its latching position.

5. An electrical connector as in claim 4 wherein the prongs have L-shaped distal ends and the hole has a communicating recess receiving said distal ends of the prongs in the latching position of the latch piece.

* * * * *